United States Patent [19]

Uchida et al.

[11] 3,936,324

[45] Feb. 3, 1976

[54] METHOD OF MAKING HIGH STRENGTH COLD REDUCED STEEL BY A FULL CONTINUOUS ANNEALING PROCESS

[75] Inventors: Kuniki Uchida; Kenzi Araki, both of Yokohama; Shiro Fukunaka, Fukuyama, all of Japan

[73] Assignee: Nippon Kokan Kabushiki Kaisha, Tokyo, Japan

[22] Filed: Mar. 14, 1975

[21] Appl. No.: 558,326

[52] U.S. Cl. ..... 148/12 F; 148/12.3; 148/134; 148/142

[51] Int. Cl.[2] ..... C21D 6/02; C21D 9/46

[58] Field of Search ..... 148/12 F, 12 R, 142, 134, 148/12.3

[56] References Cited

UNITED STATES PATENTS

| | | | |
|---|---|---|---|
| 3,839,095 | 10/1974 | Kubotera et al. | 148/2 |
| 3,857,740 | 12/1974 | Gondo et al. | 148/12 F |

*Primary Examiner*—W. Stallard

*Attorney, Agent, or Firm*—Flynn & Frishauf

[57] ABSTRACT

A steel being substantially made and adjusted within the range of 0.04 to 0.12% C, 0.50 to 2.00% Si, and 0.10 to 1.60% Mn, passed through ordinary hot and cold rolling processes, is subjected to a full continuous annealing process comprising the following steps:

1. recrystallization heating step; rapid heating up to the range of 650°C to 900°C at a rate of 200°C/min. and more;
2. keeping and soaking step; holding for 10 to 120 sec. at the above heating temperature;
3. ordinary cooling step; cooling to room temperature from the holding temperature;
4. and then ordinary cooling step;

becomes a utility cold reduced steel having the most suitable mechanical properties required as a safe countermeasure for an automobile and similar vehicles.

3 Claims, 1 Drawing Figure

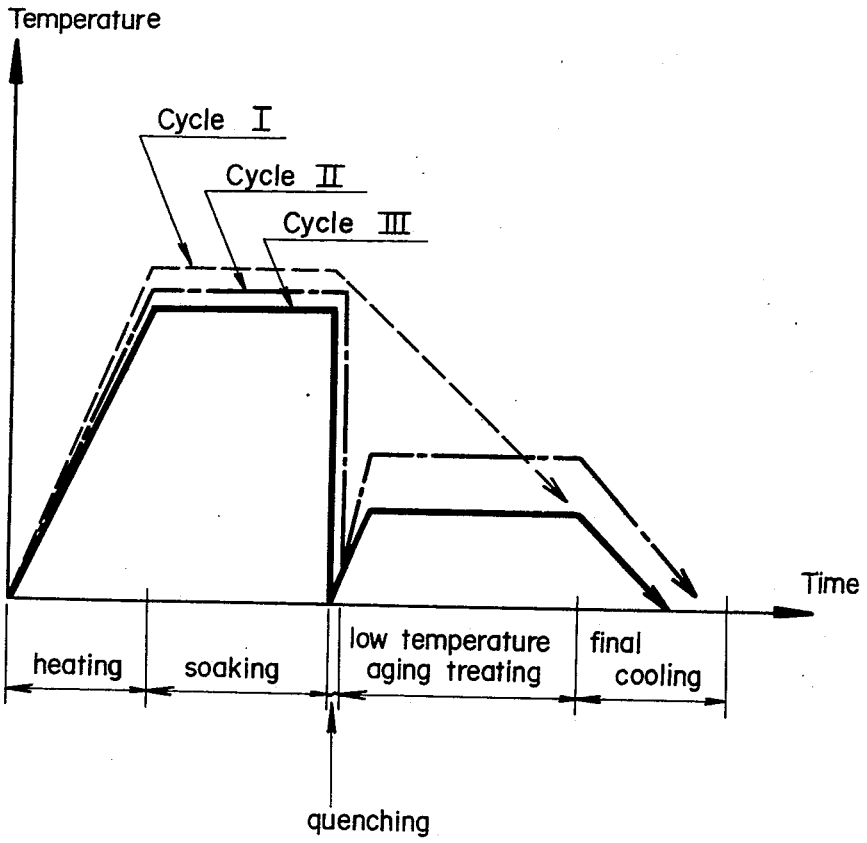
Temperature
Cycle I
Cycle II
Cycle III
Time
heating
soaking
low temperature aging treating
final cooling
quenching

METHOD OF MAKING HIGH STRENGTH COLD REDUCED STEEL BY A FULL CONTINUOUS ANNEALING PROCESS

This invention relates to an improved method of making a high strength cold reduced steel having the most suitable mechanical properties required as a safe countermeasure for an automobile, and more particularly being easily pressable into a required shape and stepping up the strength by a coating-baking treatment after the above presswork.

In recent years, a demand for high tensile cold reduced steel sheets is increasing in view of taking steps to secure the safety of an automobile and similar vehicles. However, the research and development for this type of steel has not always been sufficient to respond to such demand. The present situation is such that there is little effective or suitable means established. In viewing the situation prevailing today in the industry, it is found that the usual practice for making the above-mentioned high strength cold reduced steel is to add expensive elements such as Mn, Ti, Nb or V and to anneal the steel by a batch type. However, it is well known that such a method has the following defects.

1. addition of expensive elements in a large amount causes an increase in costs;
2. cold reducing operation becomes difficult owing to hard quality; and
3. non-uniformity in strength is unavoidable.

Various improvements have been proposed and put to practice to replace the addition of these special elements. The representative examples of such methods are disclosed in Japanese Pat. Publication No. 40-3020, known as the BISRA Process (in U.K.) and Japanese Patent Publications No. 46-9541 and No. 46-9542, known as the Inland Steel Processes (in U.S.A.). Of these arts, the BISRA type process heats up the cold reduced steel strip to 740 to 850°C, quenches the same down to 150° to 250°C, coils the quenched strip immediately, with self-annealing based on such coiling temperature. However, C content must be increased greatly in order to obtain the required strength through such a process, and such increased amount of C naturally results in the lowering of its ductility. The process is not a completely continuous one, since the art requires the self-annealing for the coil as an indispensable step, which lowers its productivity.

The above-mentioned Inland Steel type process heats a cold reduced steel strip to a temperature above the $A_3$ point and quenches the same in water to raise its strength. However, the steel sheet obtained by this process shows a weak point in that its strength is lowered by about 15 kg/m$^2$ in a coating-baking stage after press-forming, while its ductility is inferior to its strength. In other words, the steel is hard when it is to be subjected to press-forming and becomes soft when it is finished into a product. Such a steel sheet is very difficult to deal with and calls for a greater improvement in promoting safety of an automobile, etc. No proposal has been made for making an inexpensive steel sheet which does not cause lowering of the strength after coating-baking without the addition of special elements.

The present invention has been developed to save the above-mentioned situation. The features consist in that, first, Si content in the usual composition is increased up to 0.5 to 2.00%, and, secondly, the above strip made by the ordinary process is subjected to the following full continuous annealing process. That is, the above full continuous annealing process is to be selected from the following processes depending upon the intended use and the required strength level.

1. Rapid heating to 650°C to 900°C at 200°C/min. or faster → holding for 10 to 120 seconds at the above temperature → ordinary cooling → coiling;
2. Rapid heating as mentioned above → holding as mentioned above → quenching in jet water → reheating to 300°C to 500°C × 10 to 300 seconds → ordinary cooling → coiling;
3. Rapid heating to 700°C to 900°C at 200°C/min. or faster → holding as mentioned above → quenching as mentioned above → reheating to 180°C to 300°C for 4 to 300 seconds → ordinary cooling → coiling.

An object of this invention is to provide a high strength cold reduced steel to secure safety of vehicles by a continuous annealing process.

Another object of this invention is to provide a high strength cold reduced steel exhibiting an increase in the initial strength of steel, at least to the same level, in the following coating-baking stage after a required press-forming.

A further object of this invention is to provide a high strength cold reduced steel having good workability in spite of an increase in strength without adding special elements.

Other objects and advantages of this invention will be apparent from the following description and with the accompanying drawing.

The drawing shows three patterns of heat cycles based on this invention process.

The composition of a steel effective for the purpose of this invention is controlled as follows in the steel making stage:

C: 0.04 to 0.12%
Si: 0.5 to 2.0%
Mn: 0.10 to 1.6%.

The above-mentioned composition and other elements are thus limited for the reasons given below.

C: The lower limit of 0.04% is set at the critical limit in blowing operations on an industrial scale in a converter, while the upper limit is set at 0.12% in order not to damage workability and spot weldability of steel.

Si: This element is one of the important requirements for this invention. When Si is less than 0.5%, hardly any effect of the present invention is apparent, whereas more than 2.00% Si will radically lower the ductility, almost rendering the cold reducing operation impossible. Si effects should be such that the workability is not damaged and TS value is improved as well as dispersion in strength is restrained to a minimum, in view of the balance between the tensile strength and the elongation, (TS + El) value. When a strip is subjected to a full continuous annealing process, the Si effects (other than solution hardening) based on the addition become apparent much more notably than in other processes. When the cause for such phenomenon was investigated, it was found that lower structure, particularly dislocation structure, in the cold reduced state shows an idiomorphic manner by the above-mentioned addition of Si, which causes the formation of numerous and small grains along with rapid heating-up, to which reference will be made later. Further, the said grain growth is restrained because of the short holding time, to which reference will also be made later. Such an effect of grain refining raises the tensile strength and improves the elongation. At the same time, the very narrow dispersion in strength indicates generation of hard quenching structure being restrained to a low value by Si addition even when the heating temperature is higher. Si thus plays an unparalleled role in the continuous annealing process and may be called a truly effective and suitable element in achieving the objects of the present invention. Concretely speaking, Si of 0.7 to 1.5% is recommended as the most preferable range.

Mn: The lower limit of 0.10% is set in view of red shortness, while the upper limit thereof is set at 1.6% considering the limitations in steel making operations by an open hearth or converter. The more preferable range is 0.10 to 1.00% on the side of still lower Mn content. When Mn is more than 1.00%, a two phase structure comprising said hard quenching structure and soft ferrite structure tends to form, which brings about lowering of ductility and an increase in the influence of the heating temperature on strength, and results in increasing the chance of giving a greater dispersion in material quality, particularly in tensile strength.

Al: This is added merely to adjust a degree of deoxidation and its range may be 0.002 to 0.2%.

S, P and O: They should be low in view of workability.

The steel strip consisting of the above composition does not require any special manufacturing process. Any ordinary process will suffice. In other words, they may be:

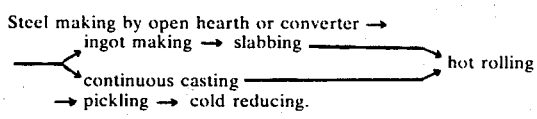

In the hot rolling stage, finishing at and coiling at a low temperature is preferred, because the coiling at a low temperature is more advantageous than that of high temperature for obtaining the strength required. The strip is then subjected to either of the following three types of continuous annealing, which is another important requirement in this invention.

Cycle I: Cold reduced strip must be subjected to a rapid heating-up at a minimum of 200°C/min., in the first step of a full continuous annealing process. This is performed to obtain a fine recrystallization structure by synergistic effect of the above idiomorphic structure caused by the addition of 0.50 to 2.00% Si and the above-mentioned rapid heating. Heating temperature x holding time is set within the range of 650° to 900°C × 10 to 120 seconds. 650°C × 10 seconds is the lower limit to obtain substantially perfect recrystallization structure. 900°C × 120 seconds is the upper limit to prevent lowering of strength and ductility caused by its grain growth. When the strip is held for more than 120 seconds, it will lower the line speed, consequently, productivity, proving industrial disadvantages. The cooling subsequent to the above step may be performed in an ordinary manner. Normal air cooling or forced air cooling is inexpensive equipment-wise and easy operation-wise. One modified method is to cool the strip to about 400°C by forced cooling, to hold the same for about 300 seconds and then cool down to room temperature for coiling. The steel thus obtained shows an increase in tensile strength by about 8 kg/mm$^2$ compared to that of a steel having the same composition and subjected to ordinary batch type annealing, and it has workability similar to that of a batch type annealed steel having the same level in strength. This demonstrates the possibility of making high strength cold reduced steel without any addition of expensive special elements and without any trouble in the cold reducing. This is the effect of Si addition being characteristic of the full continuous annealing process based on this invention process as mentioned above.

Cycle II: The strengthening mechanism in Cycle II aims at fine precipitation hardening of solute treated carbon in steel besides the above-mentioned hardening by said grain refining. Accordingly, the requirements for heating and holding are the same as those for Cycle I, with special care given to the rigorous observation of the lower limit in temperature $x$ time. The upper limit set at 900°C × 120 seconds is required by the following reasons in addition to the retraining of the recrystallized grain growth. That is, if it exceeds the above limit, difference in hardness between ferrite being ground and quenching second structure being second phase becomes greater and deteriorates the workability. Then the strip is quenched from the above heating temperature holding time to room temperature in a jet of water. Such a jet stream of cooling water is used to eliminate the vapor film generated on the surface of travelling strip, consequently to obtain a very rapid cooling rate. Solute C is frozen thereby as it is. Generally, the method employed is to jet a great amount of cooling water to the travelling strip in air or in water. As has been mentioned above, the travelling strip is quenched down to the room temperature, which process plays a very remarkable role in the successive step of carbon precipitation process. The strip, which has been quenched to room temperature, is re-heated to a temperature between 300° and 500°C. In this reheating stage, precipitation nuclei, where the majority of said solute carbon becomes fine carbides, are formed. These fine carbides cause an increase in strength and play a major part in restraining to a minimum the lowering of strength brought about by full precipitation of solute carbon. Such re-heating temperature is held for the period of 10 to 300 seconds. The lower limit of 300°C × 10 seconds is the minimum rate possible to precipitate the solute carbon to which reference has been made so far. The upper limit is set at 500°C × 300 seconds to prevent the coarsening of fine carbides and to secure contribution of such carbides toward strength. If the holding time exceeds 300 seconds, the line speed will be slowed down and its productivity will be low. Such a precipitating treatment (a low temperature aging treating), that is, the treatment of precipitating the solute C as fine carbides in advance by the above-mentioned quenching, is very effective in preventing the lowering of strength accompanying precipitation of a great amount of solute carbon in the coating-baking process after press-forming, and it is also a prerequisite in Cycle II along with the above-mentioned rapid heating-up treatment. The strip thus treated is finally cooled down to room temperature and coiled, but there is no restriction laid on the cooling and a normal, forced air cooling proves advantageous industrially.

The quality of steel obtained in the above-mentioned manner shows further improvement over that of Cycle I, and the raising of 3 to 15 kg/mm$^2$ over that of Cycle I in tensile strength is confirmed. It also shows a better formability compared to the batch type annealed materials being of the same level in strength. It is needless to say that this is caused by the synergistic effect of grain refining by Si addition, which is brought about a continuous annealing process, and precipitation hardening of fine carbides.

Cycle III: Cycle III differs from the above Cycle II in that a part of solute C is left as it is in its low temperature aging treatment. For this purpose, reheating after quenching should be performed within 180° to 300°C × 4 to 300 seconds. If reheating is below 180°C × 4 seconds, said solute C becomes impossible to precipitate in such a heat treatment of continuous annealing process, while if it exceeds 300°C × 300 seconds, the precipitation of solute C is full. The reason why the reheating process, i.e., the low temperature aging process, in Cycle III is thus limited is because so-called AA effects (accelerated aging effects) are not anticipated in the coating-baking stage after press-forming In other words, the solute carbon partically remaining after precipitation treating as mentioned above becomes precipitated as fine carbides in the coating-baking stage after press-forming and these carbides bring about the improved increase in strength (AA effects). That steel is comparatively soft at the time of press-forming and shows a higher strength as a baked product than that of its mother steel, and is most preferable for vehicle safety.

In order to further promote the effect by a carbon precipitation treatment based on low temperature aging, it is necessary to further increase the amount of the solute C by more quenching than that in Cycle II. Accordingly, the heating-up temperature after cold reducing should be set at least at 700°C and higher. Thereby, the solute C at the time of reheating after quenching increases; consequently, sufficient AA properties are obtained with ease.

The requirements other than the heating-up temperature after cold reducing and in the carbon precipitation treating may be identical to those in Cycle II. The thus obtained coil is temper-rolled by 0.5 to 2.0% and shipped to the users. When the user is an automobile-maker, a car shell is completed through the process of press-forming → assembling → coating → baking. The baking process is usually performed for 100°C to 180°C × 10 minutes to 60 minutes, wherein the AA effects of its steel are fully exerted. It is possible to raise its yield strength exceeding 10 kg/mm², and to raise its tensile strength by 5 to 30 kg/mm² more than those of Cycle I, while formability is better than a batch type annealed steel showing the same level in strength.

The accompanying drawing shows a pattern of the above three types of continuous annealing heat cycles. These cycles should be selected concretely depending on the intended use of steel and the required level in strength. Even if any cycle is selected, it is possible to make a high strength cold reduced steel with high productivity, low costs and ease, and the resulting steel shows excellent formability and strength compared to those produced in accordance with the usual batch type annealing.

The examples showing effects by this invention process are shown in Table I. The manufacturing requirements not shown in Table I are:

Hot rolling finishing temperature: 830° to 880°C
Hot rolling coiling temperature: 550° to 620°C
Hot rolled final thickness of strip: 2.8 mm.
Cold reduced final thickness of strip: 0.8 mm.
Temper rolling rate: 0.8 to 1.5%
Baking requirements: 180°C × 30 minutes.

TABLE I (° the present invention steels)

| Steel | Object | Composition (%) C | Si | Mn | Al | Cycle | Heat treating requirements Heating Rate | Heating Soaking |
|---|---|---|---|---|---|---|---|---|
| 1 | Influence | 0.08 | 1.02 | 0.35 | 0.027 | Batch annealing | 100°c/hr | 800°c × 3hr |
| ° 2 | of | " | " | " | " | Cycle I | 800°c/min | 800°c × 60sec |
| ° 3 | heating | " | " | " | " | Cycle II | " | " |
| ° 4 | cycle | " | " | " | " | Cycle III | " | " |
| 5 | Influence | 0.07 | 0.09 | 0.48 | 0.033 | Batch annealing | 40°c/hr | 700°c × 3hr |
| 6 | of | " | " | " | " | Cycle II | 800°c/min | 720°c × 60sec |
| ° 7 | Si | 0.06 | 0.75 | 0.31 | 0.012 | " | " | " |
| ° 8 | content | 0.08 | 1.39 | 0.27 | 0.004 | " | " | " |
| 9 | | 0.08 | 2.51 | 0.47 | 0.072 | — | — | — |
| ° 10 | Influence of C | 0.08 | 1.02 | 0.35 | 0.027 | Cycle II | 800°c/min | 800°c × 60sec |
| 11 | content | 0.15 | 0.92 | 0.42 | 0.046 | " | " | " |
| ° 12 | Influence of | 0.08 | 1.02 | 0.35 | 0.027 | Cycle III | 600°c/min | 800°c × 40sec |
| ° 13 | Mn | 0.06 | 0.96 | 0.99 | 0.012 | " | " | " |
| ° 14 | content | 0.07 | 1.11 | 1.58 | 0.051 | " | " | " |
| 15 | Influence of | 0.08 | 1.02 | 0.35 | 0.027 | Cycle I | 10°c/min | 720°c × 120sec |
| ° 16 | heating- | " | " | " | " | " | 600°c/min | " |
| ° 17 | rate | " | " | " | " | " | 4200°c/min | " |

| Heat treating requirements Quenching | Aging treatment | 1% temper-rolling YP kg/mm² | TS kg/mm² | El % | TS+El | After baking YP kg/mm² | TS kg/mm² | AA effects Δ YP kg/mm² |
|---|---|---|---|---|---|---|---|---|
| — | — | 27.5 | 38.3 | 38.6 | 76.9 | 27.7 | 38.1 | |
| — | — | 38.6 | 50.2 | 33.8 | 84.0 | 38.8 | 50.5 | +0.2 |
| In jet of water | 400°c × 60sec | 42.2 | 58.1 | 26.7 | 84.8 | 44.5 | 58.2 | +4.3 |
| " | 250°c × 60sec | 47.2 | 62.3 | 24.5 | 86.8 | 58.6 | 62.5 | +10.4 |
| — | — | 19.2 | 33.1 | 46.0 | 79.1 | 19.0 | 33.0 | |
| In jet of water | 350°c × 60sec | 30.1 | 42.2 | 35.0 | 77.2 | 31.1 | 42.3 | |
| " | " | 40.2 | 55.7 | 29.2 | 84.9 | 45.2 | 55.9 | |
| " | " | 49.2 | 60.3 | 25.2 | 85.5 | 54.2 | 60.7 | |
| — | — | — | — | — | — | — | — | — |
| In jet of water | 400°c × 60 sec | 42.2 | 58.1 | 26.7 | 84.8 | 44.5 | 58.2 | |
| " | " | 55.1 | 69.3 | 12.5 | 81.8 | 58.1 | 69.2 | |
| " | 250°c × 120sec | 47.2 | 61.3 | 25.9 | 87.2 | 57.7 | 63.2 | +10.5 |
| " | " | 55.0 | 74.6 | 22.1 | 96.7 | 67.0 | 75.9 | +12.0 |
| " | " | 56.3 | 77.3 | 16.3 | 93.6 | 68.9 | 77.5 | + 12.6 |
| — | — | 28.6 | 41.2 | 40.0 | 81.2 | 29.9 | 41.2 | |
| — | — | 37.2 | 49.8 | 34.1 | 83.9 | 39.2 | 49.6 | |
| — | — | 40.0 | 51.0 | 34.0 | 85.0 | 39.8 | 51.3 | |

TABLE I-continued

| Steel | Object | (° the present invention steels) Composition (%) C | Si | Mn | Al | Cycle | Heat treating requirements Heating Rate | Heating Soaking |
|---|---|---|---|---|---|---|---|---|
| 18 | Influence | 0.08 | 1.02 | 0.35 | 0.027 | Cycle II | 600°c/min | 600°c × 90sec |
| °19 | of | " | " | " | " | " | " | 700°c × 90sec |
| °20 | heating | " | " | " | " | " | " | 800°c × 90sec |
| 21 | temperature | " | " | " | " | " | " | 920°c × 90sec |
| 22 | Influence of rapid | " | " | " | " | Cycle III | 4200°c/min | 800°c × 60sec |
| °23 | cooling | " | " | " | " | " | " | " |
| 24 | Influence | " | " | " | " | — | " | " |
| °25 | of | " | " | " | " | Cycle II | " | " |
| 26 | aging | " | " | " | " | " | " | " |
| 27 | treatments | " | " | " | " | " | " | " |
| 28 | Material | 0.15 | tr | 0.52 | 0.013 | " | " | " |
| 29 | of | 0.06 | " | 1.21 | 0.036 | " | " | 700°c × 60sec |
| 30 | no Si- | " | " | " | " | " | " | 800°c × 60sec |
| 31 | addition | " | " | " | " | " | " | 900°c × 60sec |

| Heat treating requirements Quenching | Aging treatment | 1% temper-rolling YP kg/mm² | TS kg/mm² | El % | TS+El | After baking YP kg/mm² | TS kg/mm² | AA effects ΔYP kg/mm² |
|---|---|---|---|---|---|---|---|---|
| In jet of water | 450°c × 30sec | — | — | — | — | — | — | — |
| " | " | 40.4 | 55.2 | 29.2 | 84.4 | 45.6 | 55.5 | |
| " | " | 43.2 | 58.3 | 27.6 | 85.9 | 46.3 | 58.2 | |
| " | " | 52.1 | 65.2 | 13.6 | 78.8 | 53.0 | 65.5 | |
| In still water | 250°c × 60sec | 42.1 | 55.0 | 25.0 | 80.0 | 47.0 | 54.7 | +4.9 |
| In jet of water | 250°c × 60sec | 46.3 | 60.3 | 26.5 | 86.8 | 57.2 | 61.7 | +10.9 |
| " | — | 60.1 | 75.1 | 18.5 | 93.6 | 50.3 | 60.1 | −9.8 |
| " | 350°c × 90sec | 42.5 | 57.3 | 28.5 | 85.8 | 45.9 | 58.5 | |
| " | 600°c × 90sec | 40.0 | 50.7 | 32.1 | 82.8 | 41.1 | 50.5 | |
| " | 350°c × 10min | 39.5 | 50.2 | 33.5 | 83.7 | 40.0 | 50.7 | |
| " | 350°c × 90sec | 53.1 | 65.3 | 15.2 | 80.5 | 54.2 | 65.4 | |
| " | " | 37.2 | 48.3 | 30.2 | 78.5 | 39.2 | 49.1 | |
| " | " | 50.5 | 65.1 | 18.6 | 83.7 | 51.2 | 65.0 | |
| " | " | 55.3 | 75.7 | 15.3 | 91.0 | 56.5 | 75.2 | |

Table II shows the standard levels of the ordinary type batch annealed materials in mechanical properties.

TABLE II

| TS | Standard level | | Composition System | TS Kg/mm² | El % | TS + El Kg/mm²+% |
|---|---|---|---|---|---|---|
| 45 | Kg/mm² | Grade | C-Si-Mn-Nb | 47.2 | 32.9 | 80.1 |
| 50 | " | " | C-Si-Mn-Nb | 53.3 | 27.8 | 81.1 |
| 55 | " | " | C-Si-Mn-Nb-Ti | 57.8 | 24.9 | 82.7 |
| 60 | " | " | C-Si-Mn-Nb-Ti | 62.5 | 21.7 | 84.2 |
| 70 | " | " | C-Si-Mn-Nb-Ti | 71.2 | 16.9 | 88.1 |
| Annealing requirement: | | | 720°C × 3 hrs. | | | |
| Thickness: | | | 0.8 mm. | | | |

Generally speaking on the mechanical properties of steel, its elongation tends to be lowered as its tensile strength is increased. Accordingly, the workability of steel should be evaluated by considering a variation in its tensile strength along with a value of its elongation since it is insufficient to be done by said elongation alone. In the above-mentioned Table I, a value of (TS + El) is employed as a yardstick to represent said workability. That is to say, the larger the value of (TS + El) becomes, the better the workability becomes for its strength. Table II shows the standard level in workability of steel manufactured in an ordinary batch type annealing process, which is specially expressed with the above yardstick of (TS + El). Table II shows that steels of 50 kg/mm² to 55 kg/mm² in TS show about 82 in said (TS + El); 60 kg/mm² grade, that of 84; and 70 kg/mm², that of 88. Comparing steels in the above yardstick, i.e., a value of (TS + El), the excellent workability of this invention steel is made clear.

Steels 1 to 4 in Table I were observed in respect of a fundamental effect by the heating cycles. It is found that the tensile strength of a steel having such composition as that of this invention steel which is subjected to ordinary batch type annealing process (Steel 1) is only about 40 kg/mm² grade; whereas that of the above steel subjected to Cycle I of this invention (Steel 2) is increased by more than 10 kg/mm², and said steel of 40 kg/mm² grade was raised to a high strength cold reduced steel of 50 kg/mm² grade. Simultaneously, the workability of said Steel 2 (i.e., TS + El) was very good for its strength, that is, 84.0. This value exceeds that of 50 kg/mm² grade steel shown in Table II, eloquently demonstrating the grain refining effect by the full continuous annealing performed on Si added steel. The fact that ΔYP of steel after baking was +0.2 kg/mm² without lowering its yield point bespeaks that the grain refining effect is still held on a finished product and that said Cycle I process on the Si-added steel is very useful along with high productivity depending upon the full continuous annealing process.

When Cycle II in accordance with the present invention is applied to the above steel (Steel 3) in place of said Cycle I, it is possible to further improve the properties of the above steel, as is clear from the above. That is to say, said TS is thereby increased by about 8 kg/mm²; consequently, the steel is raised to a high strength cold reduced steel of 60 kg/mm² grade shown in Table II, and its workability (TS + El) showed the same value of 84.8 as that of said Cycle I for the above increase in strength. The fact that its ΔYP after baking is +4.3 kg/mm² should be noted as a good AA effect. It is needless to say that this is based on a synergistic effect of the grain refining by adding Si and the precipitation of fine carbides. When Cycle III of this invention is applied to the above-mentioned steel, to which Cycles I and II were applied as mentioned above respectively, its mechanical properties are further improved over those of Cycle II. These results are as shown on Steel 4 in Table I. That is, the value of (TS + El) is raised to 86.8 in spite of the increased TS of more than 62 kg/mm² and more particularly the increasing of ΔYP reached more than +10 kg/mm², which means an excellent AA effect and is a match for that of C-Si-Mn-Nb-Ti system steel of 60 kg/mm² grade shown in Table II. And moreover, such a special element as Nb or Ti in the referred steel is not included in said Steel 4, which results in a low cost along with high productivity of a full continuous annealing process. It will be understood that the precipitation effect of the solute carbon being partially caused to stay in steel at the full continuous annealing stage as fine carbides at the baking stage is very good. Thus, either one of Cycles I, II and III in accordance with the present invention is quite effective for a safety feature in automobiles, etc., and a selection from these Cycles naturally depends on the full continuous annealing facilities to be employed as well as on a level of strength required for the intended use of steel obtained. The influence by other requirements, except those by the above heat cycles, is clarified in respect of the examples, Steel 5 and others.

Steels 5 and 9 were investigated as to Si content. Steels 5 and 6 both contain Si in an amount less than the range of this invention. Even if the above heat Cycle II was applied to such low Si steel (Steel 6) there is not seen sufficient effect by the full continuous annealing process on a Si-added steel nor improvement in workability. However, Steels 7 and 8, to which Si is added sufficiently, show truly remarkable improvement in strength and workability. When Si is increased to 2.51% as in the case of Steel 9, edge crack was caused during cold reducing, making further sample manufacture impossible. Si content, therefore, should be limited to below 2.00% at most and preferably within the range of 0.7 to 1.5% as in the case of Steels 7 and 8.

Steels 10 and 11 were observed in respect of an influence of Mn on them. As Mn content increased, its strength is found to improve greatly. However, if Mn is as high as 1.38%, as in Steel 14, (TS + El) value tends to become lower in spite of the very excellent strength and ΔYP value representing said AA effect. This is because of the appearance of the quenching structure (i.e., martensite) as Mn% becomes unnecesarily higher. Accordingly, such high Mn content should be avoided and Steel 13, which contains about (1% Si + 1% Mn) shows the most stably balanced properties and may be called a most preferable steel. Steel 13 shows about 20 kg/mm² in strength and excellent value of (TS + El), namely 96.7, far surpassing those of the low alloy steels shown in Table II. It is recommended that Mn be suitably selected on the lower side of 1.00%, depending upon the level of strength required.

Steels 15 and 17 were studied in respect of the influence of a heating rate on cold reduced steel, which is one characterizing factor of the present invention. When said heating rate is slow, as in the case of Steel 17, said grain refining effect caused by Si addition, which is not apparent in a batch type annealing process, cannot be exerted, and the resulting strength is only about 40 kg/mm². However, as the heating rate is accelerated, its strength is increased, as is the case for Steels 16 and 17, wherein the strength is 50 kg/mm² grade and (TS + El) value exceeds 83. These surpass the values of low alloy steels in Table II and truly demonstrate the utility of the present invention employing only the above Cycle I.

Steels 18 to 21 reveal the influence of heating temperature for a cold reduced steel. When said temperature is as low as 600°C, as in the case of Steel 18, the steel obtained shows no elongation whatsoever and no tension test was possible. On the contrary, Steel 21 shows radical deterioration in workability for an increase in strength with its very high temperature of 920°C. This should be avoided. Steels 19 and 20, however, show that their strength and workability are well balanced and their yield points after baking are considerably raised as shown in Table I.

Steels 22 and 23 were observed in respect of the influence of the quenching method employed. Quenching in still (not agitated) water, as for Steel 22, makes unclear the characteristics of Cycle III specially aiming at AA effect. That is, ΔYP is about 44.9 kg/mm², which is not much different from that of said Steel 19 subjected to Cycle II, specially not aiming at AA effect. While ΔYP of Steel 23, which was quenched in said jet stream of water, is as large as +10.9 kg/mm², and its (TS + El) value is very high at 86.8 for its increased strength of 60.3 kg/mm². Thus, said quenching in the still water alone is undeniably insufficient for forming the solute C in steel.

Steels 24 to 27 were observed in respect of the influence of aging treatment requirements. Steel 24 is an example where no carbon precipitation treatment by low temperature aging was performed. This steel is very hard and has a TS value of 75 kg/mm², and radically lowered values of YP and TS after baking, namely, −9.8 kg/mm² and −15 kg/mm², respectively. These steels are naturally most unsuitable for any ordinary uses, let alone for automobiles, etc., for safety considerations. On the other hand, Steel 26 with a high treating temperature of 600°C and Steel 27 with a long holding time of more than 10 minutes tend to lower their strength and their workability. These are the undesirable influences caused by grain growth of said fine carbide precipitated in the treatment of the above temperature time. If the steels are within the limited range of said treating temperature $x$ time, as in the case of Steel 25, both ΔYP and ΔTS will not be decreased and it is easily possible to maintain stable strength and workability.

Steels 28 to 31 are examples aiming at an increase in strength by other element alone without any substantial addition of Si. Steel 28 is obtained by increasing C content alone and shows a low (TS + El) value of 80.5 for a TS value of 65.3 kg/mm². It is evident that this is far inferior to the level of the same strength of steel in Table II. Steels 29 to 31 are obtained by increasing Mn content alone. These steels were heated up to 700°C (Steel 29), 800°C (Steel 30) and 900°C (Steel 31), respectively. In every case, workability is found to be quite inferior for its strength. What should be noted here is a remarkable influence of a heating-up temperature on strength. This means that the variance in TS corresponding to that of the heating-up temperature is very great when the variance in the heating-up temperature of the continuous annealing process is considered. When Si in the range of the present invention is added with the treating requirements being within the limited range, such aforementioned variance is not seen and uniform quality of material is easily obtainable.

We claim:

1. An improved method of making a high strength cold reduced steel having most suitable mechanical properties required as safe countermeasures for an auto-car and other vehicles, chracterized in that the chemical composition is substantially adjusted within the range of 0.04 to 0.12% C. 0.50 to 2.00% Si, 0.10 to 1.60% Mn, unavoidable impurities and Fe, after cold reducing through the ordinary making process, the obtained cold reduced steel strip is subjected to the following full continuous annealing process in which:

a. recrystallization heating step rapidly heating the travelling strip to the range of 650°C to 900°C at rate of 200°C/min and more,
b. keeping and soaking step holding the strip for 10 to 120 sec. at the above heating temperature,
c. ordinary cooling down step to the room temperature from the above holding temperature,
d. and then ordinary coiling step.

2. The improved method as set forth in claim 1 wherein the full continuous annealing process comprises the following;

a. recrystallization heating step rapidly heating the travelling strip to the range of 650°C to 900°C at rate of 200°C/min and more,
b. keeping and soaking step holding the strip for 10 to 120 sec. at the above heating temperature,
c. rapid cooling step quenching the strip into a jet stream of water to the room temperature,
d. re-heating step to the range of 300°C to 500°C,
e. keeping and soaking step holding the strip for 10 to 300 sec. at the above re-heating temperature,
f. ordinary cooling down step to the room temperature from the above holding temperature,
g. and then ordinary coiling step.

3. The improved method as set forth in claim 1 wherein the full continuous annealing process comprises the following;

a. recrystallization heating step rapidly heating the travelling strip to the range of 650°C to 900°C at rate of 200°C/min and more,
b. keeping and soaking step holding the strip for 10 to 120 sec. at the above temperature,
c. rapid cooling step quenching the strip into a jet stream of water to room temperature,
d. re-heating step to the range of 180° to 300°C,
e. keeping and soaking step holding the strip for 4 to 300 sec. at the above re-heating temperature,
f. ordinary cooling down step to the room temperature from the above holding temperature,
g. and then ordinary coiling step.

* * * * *

UNITED STATES PATENT AND TRADEMARK OFFICE

CERTIFICATE OF CORRECTION

PATENT NO. : 3,936,324

DATED : February 3, 1976

INVENTOR(S) : KUNIKI UCHIDA et al

It is certified that error appears in the above-identified patent and that said Letters Patent are hereby corrected as shown below:

Abstract, line 13: replace "cooling" with --- coiling ---.

Column 5, line 18: replace "partically" with --- partially ---.

Column 11, Claim 1, fourth line: replace "chracterized" with --- characterized ---.

Signed and Sealed this

Twentieth Day of July 1976

[SEAL]

*Attest:*

RUTH C. MASON
*Attesting Officer*

C. MARSHALL DANN
*Commissioner of Patents and Trademarks*